United States Patent [19]

Smith

[11] 3,987,737

[45] Oct. 26, 1976

[54] COLLAPSIBLE DISPLAY STAND

[76] Inventor: Irving Smith, 135-24 62nd Ave., Flushing, N.Y. 11367

[22] Filed: July 15, 1974

[21] Appl. No.: 488,802

Related U.S. Application Data

[63] Continuation-in-part of Ser. No. 341,776, March 15, 1973, abandoned.

[52] U.S. Cl. ..... 108/111; 211/149; 248/174

[51] Int. Cl.[2] ..... A47B 43/02

[58] Field of Search ..... 108/111, 99; 211/135, 211/149; 248/174

[56] References Cited

UNITED STATES PATENTS

| | | | |
|---|---|---|---|
| 272,620 | 2/1883 | Baier | 108/99 |
| 2,155,190 | 4/1939 | Heinz | 211/135 |
| 3,362,610 | 1/1968 | Van Dyke | 211/135 |
| 3,508,734 | 4/1970 | Thomas | 248/174 X |
| 3,687,091 | 8/1972 | Boylan | 108/111 |
| 3,721,413 | 3/1973 | Robinson | 248/174 |

*Primary Examiner*—Roy D. Frazier

[57] ABSTRACT

A collapsible display stand comprises a back wall, two side walls, and a plurality of shelf members, each of said shelf members hingedly attached to at least one of said walls and at least one of said shelf members having an extension attached to one side thereof which extends angularly of the shelf member and between said side walls.

4 Claims, 5 Drawing Figures

IRVING SMITH
INVENTOR

COLLAPSIBLE DISPLAY STAND

Related Application

This application is a continuation-in-part of my copending application, Ser. No. 341,776, filed Mar. 15, 1973, now abandoned.

BACKGROUND OF THE INVENTION

Display stands are widely used to exhibit goods in such a manner to attract a potential buyer's attention and, hopefully, entise the individual to purchase the item. Such stands can be found in supermarkets, drug stores, etc., with goods of every type, size and discription.

Most display stands come in a package containing all of the component parts of the stand which must then be assembled by the user. Often the stands are supplied by the supplier of the foods to the retail outlet. Many establishments, particularly supermarkets, leave the assembly and stocking of the display stand to the supplier's salesman. Thus, a significant amount of the salesman's time is spent in setting up the display which, of course, decreases the amount of time available to solicit additional business. It is therefore apparent that a display stand which could be easily and rapidly set up would be a welcomed improvement over the present stands which must be laboriously assembled. Summary of the Invention This invention relates to a display stand, and particularly to a collapsible display stand having a back wall, two side walls, and a plurality of shelf members hingedly attached to at least one of said walls, and at least one of said shelf members having an extension, normally extending angularly of the shelf member and between the side walls, attached to one edge thereof.

Accordingly, it is the object of this invention to provide a collaspsible display stand which can easily and instantanously assembled and disassembled. This and other objects of the invention will become apparent to those of ordinary skill in the art from the following detailed description in which.

DESCRIPTION OF THE PREFERRED EMBODIMENTS

Figure 1:
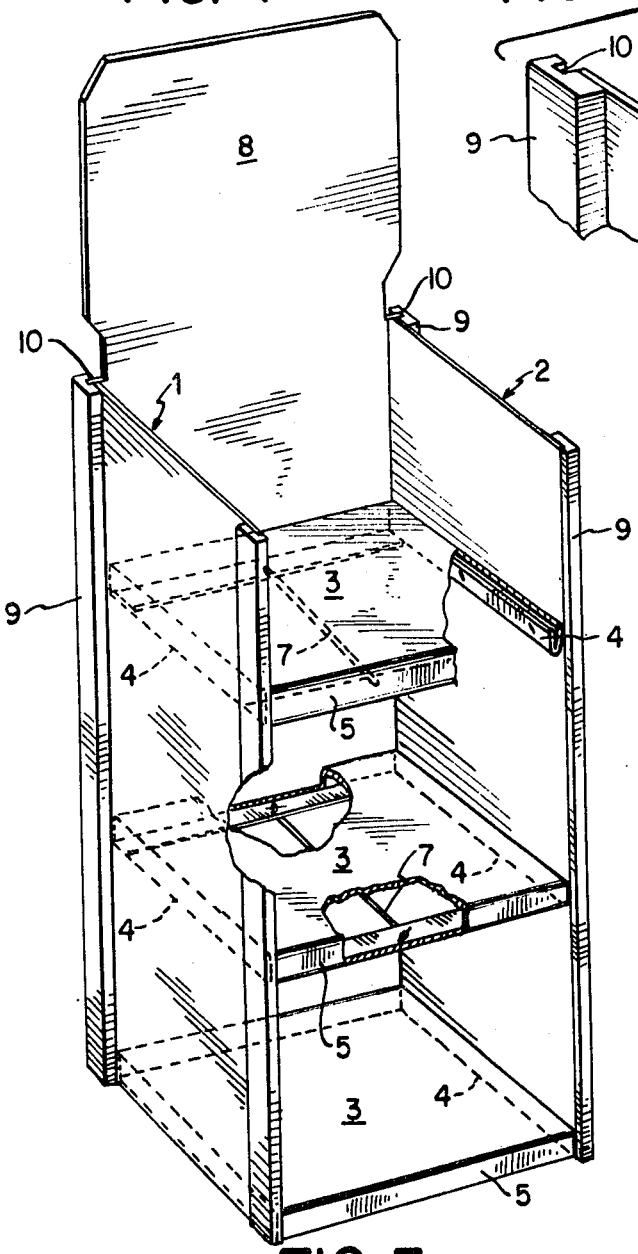
FIG. 1 is a slightly elevated view of the collapsible display stand of the present invention.
Figure 2:
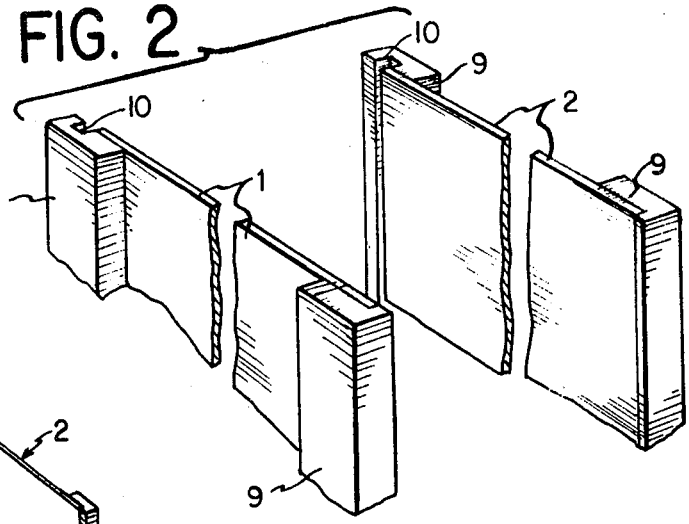
FIG. 2 is a bottom view of the display stand of FIG. 1.

FIG. 1 shows the collapsible display stand of the present invention which can be constructed of any suitable material such as wood, cardboard, or corrugated board, plastic or the like. The stand has a first side wall 1 and a second side wall 2 connected to opposing sides of a plurality of shelf members 3. Shelf members 3 can be any desired shape but are usually four sided, i.e., square or rectangular. Walls 1 and 2 are hingedly connected to the shelf members 3 so that the walls can be brought together without breaking the connection to the shelf members for compact storage or shipment of the display stand. The interconnection of walls 1 and 2 with shelf member 3 can be made in any convenient fashion, such as with a metal hinge. I prefer to use a flap 4 which is glued, stapled or otherwise secured to the side walls.

At least one shelf member 3, and preferrably all shelf members 3, is provided with a hingedly attached extension of flap 5 on at least one, and preferrably all of the remaining sides of shelf member 3. Extension 5 extends longitudinally from side wall 1 to side wall 2 and is sufficiently rigid to act as a brace.

In one preferred embodiment, extension 5 is itself provided with a similarly constructed hingedly attached extension of flap 6 which wil provide additional support for the display stand.

Extensions 5 and, if used, 6, are normally biased angularly of shelf member 3 and between side walls 1 and 2. The bias can be the result of the original construction of the extension or the result of a biasing means such as a spring attached to shelf member 3. Preferrable, I employ an elastic band 7, the ends of which are secured to opposing extensions 6,6. If extensions 5 were not normally biased between side walls 1 and 2 or if extensions 5 did not longitudinally extend from side wall 1 to side wall 2, the application of even a small force to the display stand would cause it to collapse. However, since the extensions 5 are so biased and do so extend, they act as a brace and prevent such a collapse.

If desired, a stop member (not shown) can be provided to establish a particular angular relationship between extensions 5 and shelf member 3.

A back wall 8 is attached to the display stand in any convenient fashion as by screws, clips or the like. I prefer to provide the vertical sides of side walls 1 and 2 with L-shaped uprights 9 with aligned slots 10. Back wall 8 of appropriate width is held within slots 10 and acts as a further brace for the stand.

Figure 3:
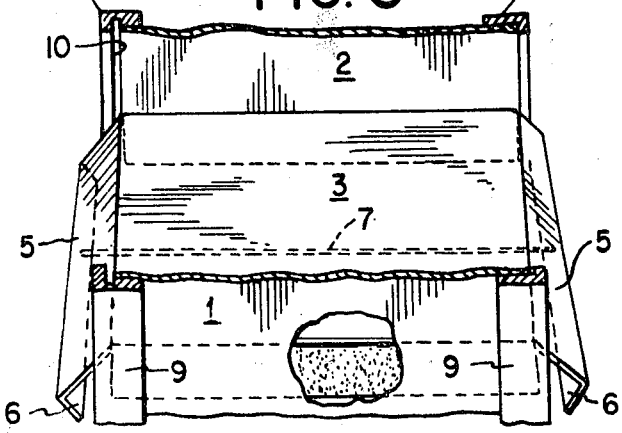
FIG. 3 is an elevated view of the top of the stand as it is being opened or closed.

The display stand shown in FIG. 1 is disassembled by sliding back wall 8 upward and out of slots 10. Extensions 5 and 6 are then pulled outward (FIG. 3) so that they swing beyond the side walls 1 and 2 and uprights 9. Since all braces have now been removed, and each side wall is hingedly attached to the shelf members 3, side walls 1 and 2 can easily be swung toward one another to form a compact unit for shipment or storage.

To assemble the display stand of the present invention, side walls 1 and 2 are merely swung apart and the normal bias of extensions 5,6 will cause extensions 5,6 to snap into their proper bracing position. Back wall 8 is then slid into the aligned slots 10.

Figure 4:
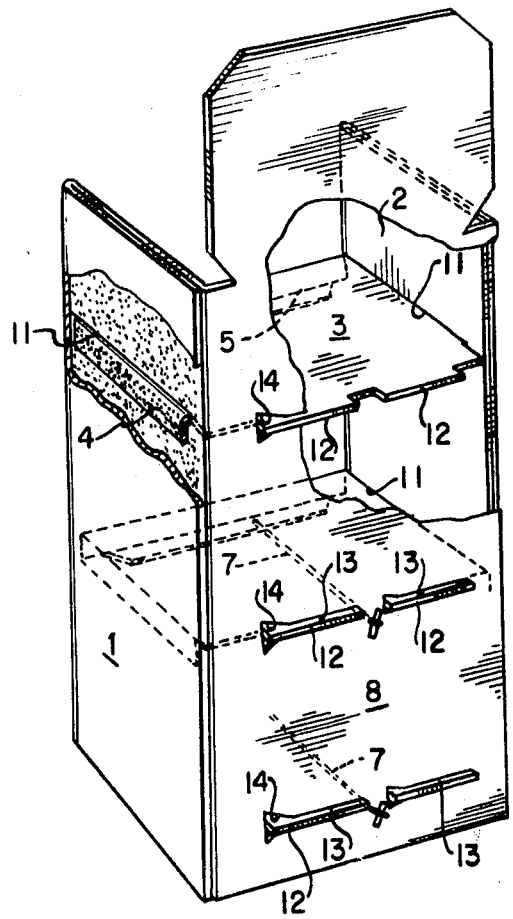
FIG. 4 is an elevated view from the right rear of another embodiment of the stand of this invention.

A second embodiment of the display stand is shown in FIG. 4. Here, no uprights 9 are used and one side of back wall 8 is hingedly attached to side wall 1. Back wall 8 is normally biased into a bracing position between side walls 1 and 2. In FIG. 4, this is accomplished by means of an elastic band 7 connecting back wall 8 and extension 5. Also in this embodiment, the flaps 4 have been inserted into pockets 11 provided in each side all and glued therein.

In FIG. 4, I have provided each shelf member 3 with a pair of tabs 12 arranged to pass through back wall 8 through slots 13 therein provided for this purpose. This arrangement gives additional support to each shelf member.

The stand of FIG. 4 is disassembled in the same manner as before, i.e., by pulling extension 5 and back wall 8 outwardly thereby removing the braces and swinging the side walls toward one another. Back wall 8 is then folded back onto side wall 1. The stand is assembled by merely swinging the side walls apart and the normal bias of extension 5 and back wall 8 cause them to snap into their normal bracing position. If tabs 12 are used, it is necessary to provide the slot 13 closest to side wall 1 with an outwardly flairing opening 14 at the end closest to the side wall. Opening 14 serves to guide tab 12 into slot 13 and if it is not used, the entrance of tab 12 into slot 13 on assembly becomes a hit or miss proposition.

Figure 5:
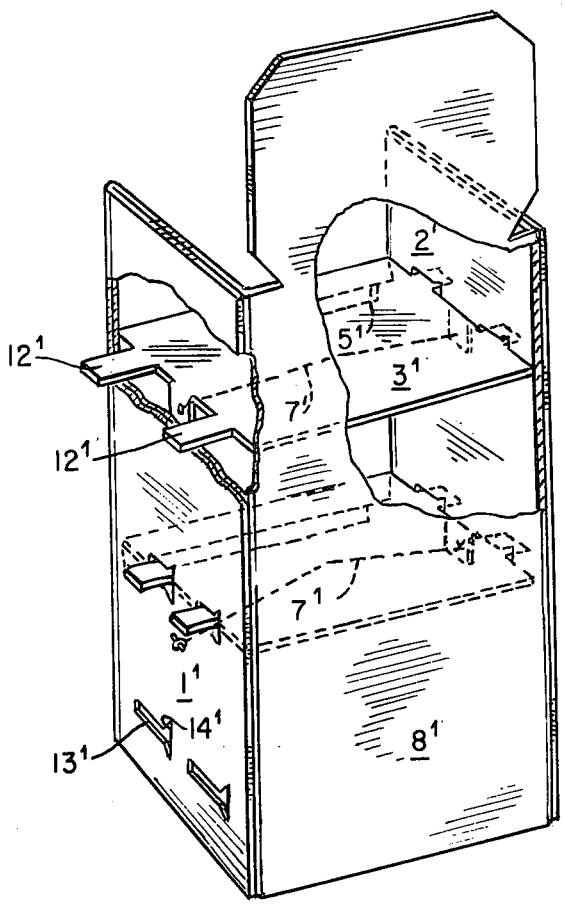
FIG. 5 is a view, similar to FIG. 4, of another embodiment of the invention.

In another and preferred embodiment, shown in FIG. 5 both side wall 1' and 2' are each hingedly attached to back wall 8' and the shelf members 3' are hingedly attached to back wall 8'. Tabs 12' are provided on the sides of the shelf members 3' and each side wall is provided with aligned slots 13' with flaired openings 14' for tabs 12'. Extension 5' is fixed on the front edge of shelf member 3' extending downwardly of shelf member 3' and between side walls 1' and 2'. The side walls 1' and 2' and shelf members 3' are biased into the open and braced position by an elastic band 7'. The ends of band 7' are fixed on side walls 1' and 2', respectively, and the middle of band 7' is attached to the bottom of shelf member 3' by any suitable means such as by a staple. I prefer to provide each of the two side edges of shelf member 3' with two outwardly extending tabs 12' separated by a downwardly extending tab 15' and to thread each elastic band 7' through the two downwardly extending tabs 15' located at the opposite ends of each shelf members 3'.

To disassemble this preferred embodiment, the two side walls are merely swung around behind the back wall and the shelf members are urged upwardly to a slight degree whereupon the biasing provided by the elastic band will urge the shelf members upwardly against the back wall. Assembly is accomplished by merely swinging the side walls toward the front of the back wall whereupon the biasing means will cause the side walls and shelf members to snap into the fully open and braced position. This embodiment is more compact than the other embodiments. Since the shelf members are hinged to the back wall and the side walls fold behind the back wall, the height of the disassembled stand is the same as the height of the assembled stand.

In the other embodiments, the height of the disassembled stand is equal to the height of the assembled stand plus the distance between the side walls as a result of the shelf members being hinged to both side walls.

Various changes and modifications can be made in the collapsible display stand of the present invention without departing from the spirit and the scope thereof. The various embodiments described herein serve to further illustrate the invention but where not intended to limit it.

I claim:

1. A collapsible display stand comprising: a back wall, two side walls hingedly attached to said back wall, and a plurality of shelf members each hingedly attached along a first edge to said back wall in vertically spaced relationship, at least one of said shelf members having an extension attached to a second edge opposite said first edge, said extension extending from side wall to side wall and normally extending downwardly of said shelf member and between said shelf walls, each of said shelf members having biasing means attached thereto and to the side walls to establish a normally generally horizontal biased position of said shelf members braced in contract with said shelf members upwardly against said back wall when said side walls are swung around behind said back wall, each of said shelf members having outwardly extending tabs on the side edges thereof which contract said side walls and said side walls having slots therein aligned with said outwardly extending tabs such that said tabs can extend through said slots.

2. The collapsible display stand of claim 1 wherein said biasing means comprises an elastic band connected to said side walls and said shelf members.

3. The collapsible display stand of claim 2 wherein the ends of said slots closest to said back wall are outwardly flaired.

4. The collapsible stand of claim 3 wherein the ends of each elastic band are attached to said side walls, and wherein each band extends through a downwardly extending tab attached to each of said side edges of said shelf members.

* * * * *